US006513826B1

(12) United States Patent
Hangl

(10) Patent No.: US 6,513,826 B1
(45) Date of Patent: Feb. 4, 2003

(54) DEVICE FOR CONNECTING A SNOW GLIDER TO THE BOOT OF A PERSON USING A SNOW GLIDER

(76) Inventor: Andreas Hangl, Chasa val Maisas, Samnaun Dorf (CH)

( * ) Notice: Subject to any disclaimer, the term of this patent is extended or adjusted under 35 U.S.C. 154(b) by 0 days.

(21) Appl. No.: 09/601,512

(22) PCT Filed: Dec. 2, 1999

(86) PCT No.: PCT/CH99/00578

§ 371 (c)(1),
(2), (4) Date: Sep. 27, 2000

(87) PCT Pub. No.: WO00/32284

PCT Pub. Date: Jun. 8, 2000

(30) Foreign Application Priority Data

Dec. 2, 1998 (CH) ..... 2392/98

(51) Int. Cl.[7] ..... A63C 5/07
(52) U.S. Cl. ..... 280/602; 280/607
(58) Field of Search ..... 280/602, 607, 280/616, 617, 618, 633, 634, 636

(56) References Cited

U.S. PATENT DOCUMENTS 3,797,844 A * 3/1974 Smolka et al. ..... 280/617
5,129,668 A * 7/1992 Hecht ..... 280/607
5,269,555 A * 12/1993 Ruffinengo ..... 280/602
5,397,149 A * 3/1995 Couderc et al. ..... 280/602
5,647,605 A * 7/1997 Arduin ..... 280/602
5,671,939 A * 9/1997 Pineau ..... 280/602
6,158,747 A * 12/2000 Magnani ..... 280/11.14
6,199,893 B1 * 3/2001 Fumagalli ..... 280/602
6,412,807 B1 * 7/2002 Arduin et al. ..... 280/607
6,431,578 B2 * 8/2002 Pederson et al. ..... 280/618

FOREIGN PATENT DOCUMENTS

WO 94/80669 * 4/1994

* cited by examiner

*Primary Examiner*—Brian L. Johnson
*Assistant Examiner*—Bryan Fischmann
(74) *Attorney, Agent, or Firm*—Browdy and Neimark, P.L.L.C.

(57) ABSTRACT

The device for connecting a ski (5) to a boot (4) of a person using the ski, the device permitting adjustment of the curvature of the ski to facilitate turning while skiing. The device (1) has intermediate parts (2, 3) arranged between the binding device (1) and the ski (5) that are secured to the ski. The base body (10) of the device (1) and the base body (20; 30) of the respective intermediate parts (2, 3) have a base plate (10; 23) with projecting strip-like members. These members (11, 12) are associated with the intermediate parts (2, 3) and have a series (15, 25, 35) of openings (14, 24, 34) corresponding to openings in the intermediate parts. The series of openings run parallel to the base plate (23). Connecting means (50) are provided that run through the openings of the members and intermediate parts that create a pivoting link between the members and the intermediate parts.

32 Claims, 7 Drawing Sheets

DEVICE FOR CONNECTING A SNOW GLIDER TO THE BOOT OF A PERSON USING A SNOW GLIDER

BACKGROUND OF THE INVENTION

The present invention relates to a device for connecting a ski to the shoe of a person using the ski.

A device of this generic type is disclosed e.g. in WO 9635488. Among other things, this device permits adjusting the curvature of a ski so as to facilitate turning in a manner not provided by prior art devices when skiing.

OBJECT OF THE INVENTION

The object of the present invention is to eliminate the disadvantages of the prior art.

This object is achieved according to the invention, in the case of the device of the generic type mentioned in the introduction by making the curvature of the ski adjustable.

BRIEF DESCRIPTION OF THE DRAWINGS

Embodiments of the present invention are explained in more detail under the reference to the enclosed drawings. It shows.

DETAILED DESCRIPTION OF THE PREFERRED EMBODIMENTS OF THE INVENTION

Among other things, the present device (FIGS. 1 to 13) includes an arrangement 1 for holding or for receiving of the shoe of the person using the ski. Intermediate pieces 2 and 3 are arranged between the mounting arrangement 1 and the ski 5. The components 1 to 3 of the present device are engaged in such a way that the distance between the intermediate pieces 2 and 3 is adjustable and lockable.

Figure 1:
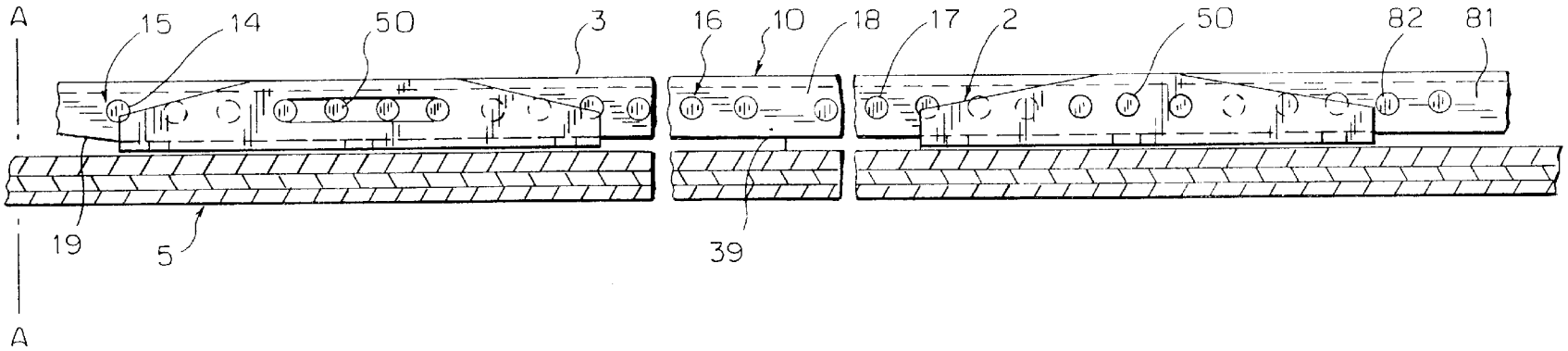
FIG. 1 in a side view a first embodiment of the present device, which shows an arrangement for holding a shoe, whereby this holding arrangement is secured by aid of intermediate pieces on the ski body.
Figure 2:
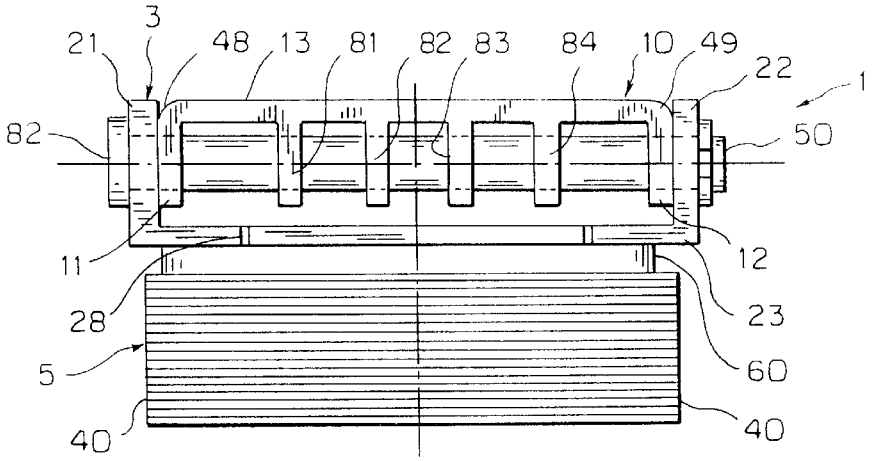
FIG. 2 is an enlarged vertical cut through the device according to FIG. 1.
Figure 4:
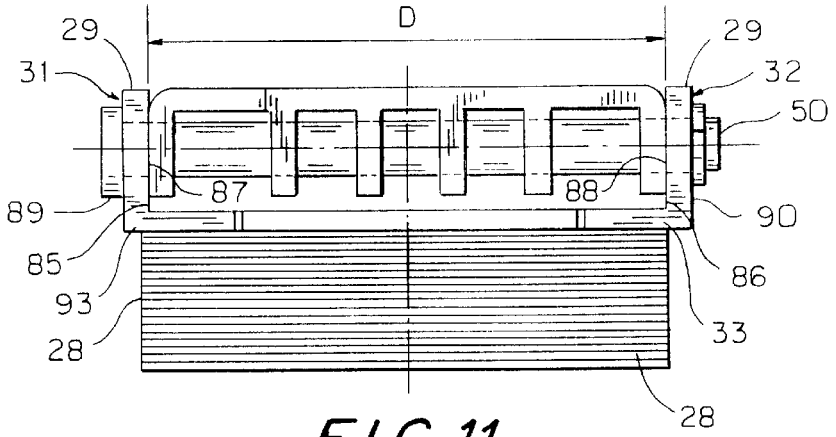
FIG. 4 is an enlarged vertical cut through the device according to FIG. 3.

The holding arrangement 1 has a main body 10 which is oblong and which has a practically U-shaped cross-section. FIG. 1 shows only sections of the oblong main body 10 in order to show its essential parts. FIG. 2 shows a vertical cut A—A, in which only the ski 5 is cut and in which the front intermediate piece 3 is represented in a side view.

The main body 10 of the holding arrangement 1 has two outer legs 11 and 12, which project out or hang down from longitudinal side edges 48 and 49 of a base plate 13 of the holding arrangement. The side edges 48 and 49 of the holding arrangement 1 extend essentially parallel to the longitudinal edges or longitudinal sides 40 of the ski 5. The outer legs 11 and 12 stand practically rectangularly to the base plate 13. Parts of one known safety binding, i.e. a front binding and a rear binding are secured in a per se known manner on the outer side or on that side of the base plate 13.

The legs 11 and 12 of the holding arrangement 1 have the form of strips which are in one piece with the base-plate 13 and which extend along the longitudinal side edges 48 and 49 of the base plate 13. The free edge 19 of the holding legs 11 and 12 has at least one section 39 which runs parallel to the base-plate 13 at least in the middle area of the length of the holding arrangement 1.

The respective holding leg 11 or 12 shows at least one row 15 of openings 14, the centers of which lie on a straight line G1 shown in FIG. 1. This straight-line G1 extends parallel to the base plate 13 of the holding arrangement 1 and parallel to the middle section 39 of the free edge 19 of the leg 11 or 12. The contour or the edge portion of these openings 14 is circular. The distances between the centers of the adjacent openings 14 are equal.

Seen in a direction perpendicular to the longitudinal direction of the holding arrangement 1, the openings 14 on legs 11 and 12 are in alignment with each other, so that each opening 14 lies on a second straight line G2 (FIG. 2). This second straight line G2 stands perpendicular to the longitudinal direction of the holding arrangement 1 and consequently also perpendicular to the first straight line G1.

As depicted in FIG. 1, the openings 14 form two groups 16 and 17 in the respective holding leg 11 or 12 so that the openings 14 of the two groups 16 and 17 lie on a common first straight line G1. Consequently, the openings 14 of the both groups form two following rows 16 and 17 of openings 14. An intermediate surface 18 is placed between the groups of the opening 16 and 17.

The main body 10 of the holding arrangement 1 shows further legs 81, 82, 83 and 84 (FIG. 2) which are placed between the outer legs 11 and 12, which are practically the same shape as the outer or exterior legs 11 and 12 and which extend parallel not only to these but also to each other.

The present device comprises furthermore the already mentioned intermediate pieces 2 and 3 (FIGS. 1 and 4 to 7) which are placed between the holding arrangement 1 and the ski 5. The first intermediate piece 2 (FIGS. 5 to 7), is assigned the rear or heel area of the holding arrangement 1 in the represented case. The second intermediate piece 3 (FIGS. 8 to 10) is placed in the area of the tiptoe of the holding arrangement 1. But it is easily possible that the intermediate pieces 2 and 3 are placed on the ski 5 also in the reverse sequence. Each of the intermediate pieces 2 or 3 includes a main body 20 or 30, which has an U-shaped or a practically E-shaped cross-section which as shown in FIG. 1 rests on a press plate 60 arranged on the upper side of the ski 5. On this press plate 60 the intermediate pieces 2 and 3 rest.

The main body 20 of the first intermediate pieces 2 (FIGS. 5 to 7) has a base plate 23. Legs 21 and 22 of this intermediate piece 2 project out from the side edges 46 and 47 of the base plate 23, whereby said edges 46 and 47 extend practically parallel to the longitudinal edges 40 of the ski 5. Said legs 21 and 22 stand practically rectangular to the base plate 23 and they project out upwards from the plate 23. The legs 21 and 22 have the form of strips, which are in one piece with the base plate 23 and which extend along the longitudinal edges 46 and 47 of the base plate 23. The edge 29 of the legs 21 and 22 extends at least in the middle area of the length of the intermediate piece 2 parallel to the base plate 23.

The distance D (FIG. 4) between the outer surfaces 87 and 88 of the outer legs 11 and 12 on the holding arrangement 1 is smaller than the distance between the inside-surfaces 85 and 86 of the legs 21 and 22 on the intermediate piece, so that the holding arrangement 1 can be put in between the legs 21 and 22 or legs 31 and 32 of the intermediate pieces 2 and 3. The distance D is chosen furthermore so that the legs 87 and 85 of the holding arrangement 1 can find a place between the legs 21 and 22 of the intermediate pieces 2 and 3, so that the side surfaces 85 and 87 or 86 and 88, which are assigned to each other lie one upon another without play and that the intermediate pieces 2 and 3 can swing with respect to the holding arrangement 1.

In the respective leg 21 or 22 of the first intermediate piece 2 there is a row 25 of openings 24 (FIG. 5), the centers of which lie on a straight line G3. This straight line G3 extends parallel to the base plate 23 of the intermediate piece 2 and also parallel to the free edge 29 of the legs 21 and 22. The contour or the edge part of the openings 24 is circular. The diameter of such holes 24 is the same as the diameter of the holes 14 in the legs 11, 12 and 81 to 84 of the holding arrangement 1. The distances between the centers of the adjacent openings 24 in the first intermediate piece 2 are the same and these distances are besides equal to the distances between the adjacent holes 14 in the holding arrangement 1. The respective end portion of the legs 21 and 22 is provided with an inclined edge 26 or 27.

The second intermediate piece 3 (FIGS. 8 to 10) is provided in the same manner as the first intermediate piece 2 except the shape of the openings 34 in the legs 31 and 32 of intermediate piece 3. The opening 34 in the respective leg 31 and 32 of this intermediate piece 3 is formed as a oblong hole the longitudinal axis of which extends parallel to the base plate 33 of intermediate piece 3. The oblong hole 34 is arranged with respect to the holes 14 in the legs 11 and 12 of the holding arrangement 1 so that the center of the oblong hole 34 is in alignment with the center of one of the circular holes 14 in the legs 11 and 12 of the holding arrangement 1.

The base plate 23 or 33 of the respective intermediate piece 2 or 3 has openings 38 through which screws 28 (FIG. 2 or 4) can go for securing of the intermediate pieces 2 and 3 on the ski 5.

In order to join the holding arrangement 1 to the intermediate pieces 2 and 3, which are secured on the ski 5, suitable connecting means 50 (FIGS. 11 to 13) are provided. One of such connecting means 50 is necessary for connecting one of the intermediate pieces 2 or 3 to the holding arrangement 1. The respective connecting means 50 is a shaft which allows pivoting movements between the holding arrangement 1 and the respective one of the intermediate pieces 2 and 3 which are attached to said arrangement 1. In the simplest case a bolt with head can serve as such a connecting means 50. The diameter of the bolt 54 of this screw 50 must correspond to the measurements of the holes 14, 24 and 34 in the holding arrangement 1 and in the intermediate pieces 2 or 3. The bolt 54 of said screw 50 is moved through the openings 14 and 24 covering each other in the legs 11 or 12 and 21 or 22 overlapping themselves in the holding arrangement 1 and in the intermediate pieces 2 and 3. A screw nut (not shown) can be screwed on the end part of the bolt 54 which projects out from the holding arrangement 1.

Figure 11:
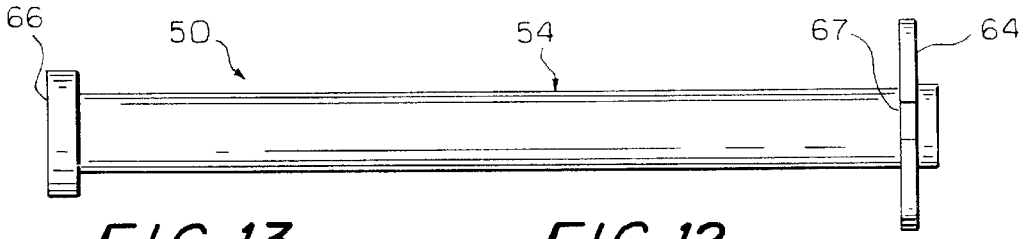
FIG. 11 is a side view of a shaft, by which the intermediate pieces are connected to the holding arrangement.

FIG. 11 shows a connecting means 50, the shaft 54 of which has a smooth cylindrical surface. One of the end parts of the shaft is equipped with a head 66. The opposite end part of the bolt 54 is provided with a circular groove 67.

The distance between the inside surface of the head 66 and the groove 67 corresponds to the distance between the outer surfaces 89 and 90 of the legs 31 and 32 of the intermediate pieces. The connecting means 50 includes furthermore a retaining element 64 which can be arranged on the shaft 54 and removed therefrom without the necessity of using a tool.

Figure 12:
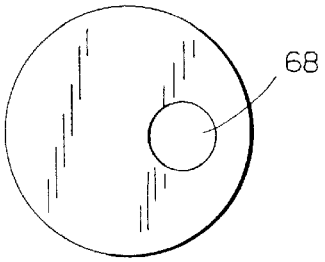
FIG. 12 is a plan view of a first embodiment of a retaining disk, which can be placed at one of the ends of the shaft of FIG. 11.
Figure 5:
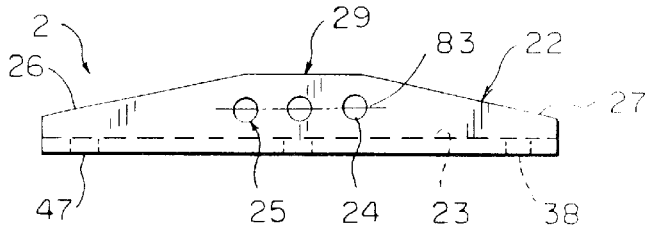
FIG. 5 is a first side view of one of the intermediate pieces shown in the FIG. 1 and 3.
Figure 6:
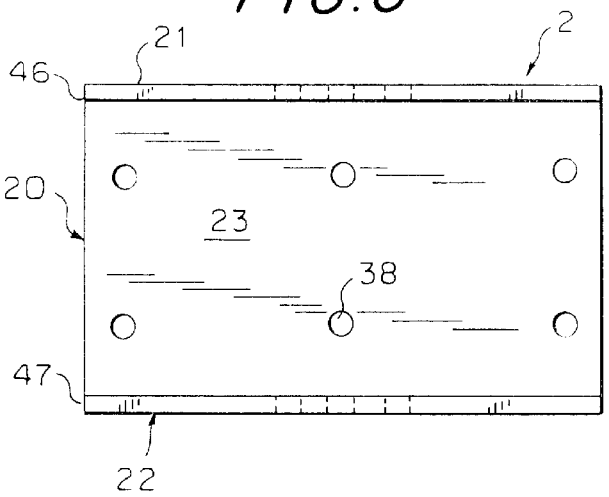
FIG. 6 is a plan view of the first intermediate piece.
Figure 7:
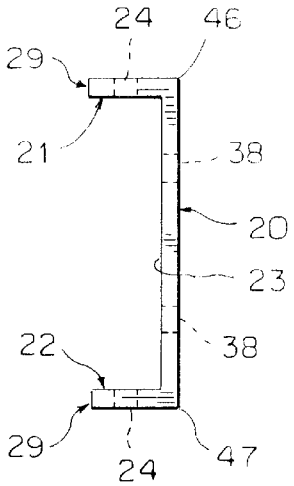
FIG. 7 is a second side view of the first intermediate piece.
Figure 8:
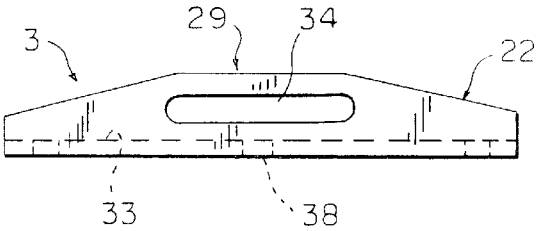
FIG. 8 is a first side view of the second of the intermediate pieces from the FIG. 1 and 3.
Figure 9:
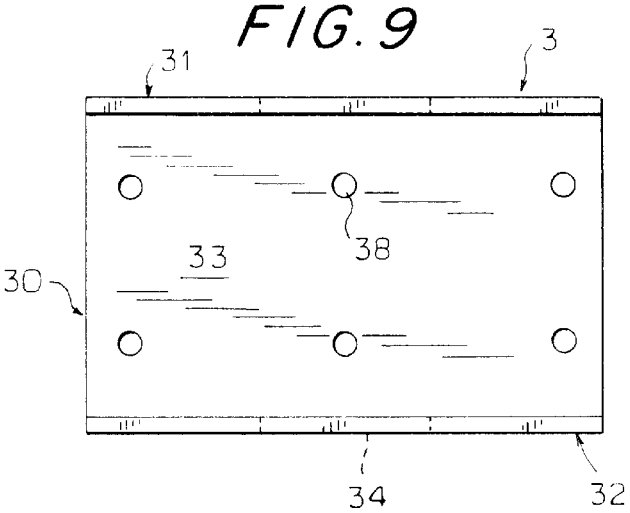
FIG. 9 is a plan view of the second intermediate piece.
Figure 10:
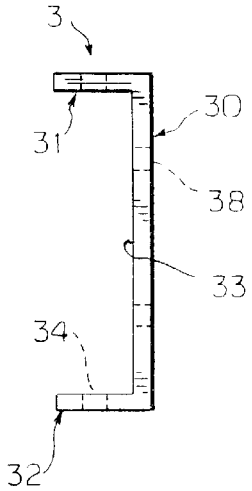
FIG. 10 is a second side view of the second intermediate piece.

The retaining element 64, which is depicted in FIGS. 11 and 12 for joining holding arrangement to intermediate pieces 2 and 3, has the shape of a disk made up from an elastical material, for example from rubber or plastic. The thickness of this disk 64 is the same as or corresponds to the width of the circular groove 67. The disk 64 is equipped with an opening 68 which lies suitably out of the middle of the disk 64. The diameter of the opening 68 corresponds to the diameter of the circular groove 67. In order to place such retaining disk 64 on the shaft 54, t he disk 64 the marginal part of the opening 68 is introduced into the groove 67. After the disk 64 is engaged in groove 67, it adopts its original measurements again.

Figure 13:
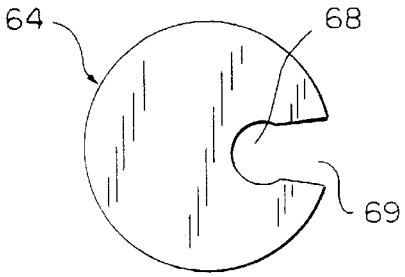
FIG. 13 is a plan view of a second embodiment of the retaining disk.

FIG. 13 shows a retaining disk 64 which is formed from metal and which has also the opening 68. A slit 69 is formed between said opening 68 and the outer edge of the disk 64. The distance of the edges of this slit 69 in the area of the narrowest section of this slit 69 is smaller than the diameter of the ground of the groove 67. The disk 64 snaps consequently in on the ground of that circular groove 67, after it has been pressed into circular groove 67.

As it is apparent from the foregoing, the respective connecting means 50 serves as a swing axis. One of these swing axes 50 goes through the openings 14 in the front group 16 in the holding arrangement 1, which are assigned to each other and through the openings 34 in the second intermediate piece 3 which are assigned to each other and which are in alignment with the leg openings 14 in the holding arrangement 1. The second swing axis 50 goes through the leg openings 14 in the rear group of opening 17 in the holding arrangement 1, which are assigned to each other, and through openings 24 in the first intermediate piece 2, which are assigned to each other and which are in alignment with the leg openings 14 in the holding arrangement 1.

Under circumstances it can be of advantage, to make the intermediate pieces 2 and 3 in one piece with the ski 5. This makes it possible, to manufacture the intermediate pieces 2 and 3, which can be also called adapters, in one piece with the ski 5. In such a case, the holding arrangement 1 together with the binding parts can merely be put on said intermediate pieces 2 and 3. Besides, a still further reduction of the height of the base plate 13 of the holding arrangement 1 over the ski 5 can be reached by aid of said measure. This measure can for example be used if the body of the ski is short. The lower edges of the legs 21 and 22 or 31 and 32 can be embedded in the ski 5 or the legs 21 and 22 or 31 and 32 can be formed from the material of the ski 5.

Figure 3:
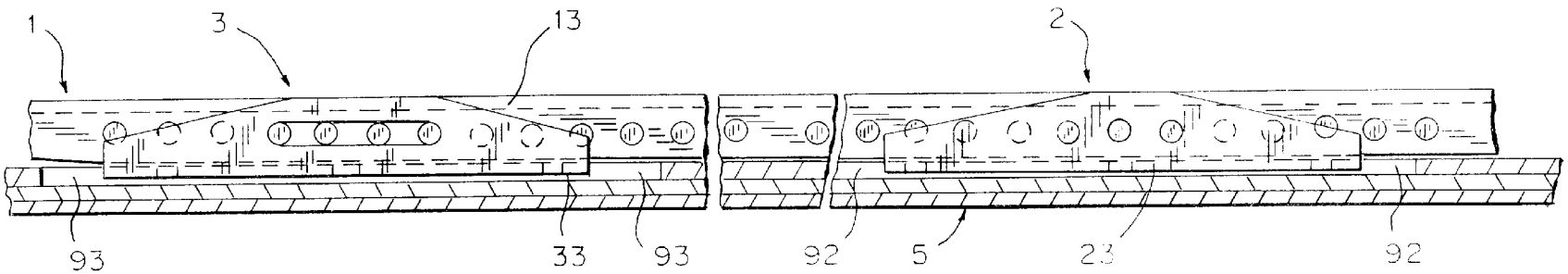
FIG. 3 is a side view of a second embodiment of the present device.

FIG. 3 shows further embodiment of the present device The base plates 23 and 33 of the intermediate pieces 2 and 3 are in this case embedded in the upper side of the ski 5. Flat deepenings 92 and 93 are formed in the upper side of the ski 5, the depth of which corresponds to the thickness of the base plates 23 and 33. The base plates 23 and 33 of the intermediate pieces 2 and 3 lie in these deepenings 92 and 93 and they can be secured here by aid of the screws 28. That one measurement of the deepenings 92 and 93, which extends parallel to the longitudinal direction of the ski 5, can either be as same as the length of the base plate 23 or 33, so that the base plate 23 or 33 is immovably embedded in such a deepening 92 or 93, or the longitudinal measurement of the deepening 92 or 93 can be larger than the length of the base plate 23 or 33. If the longitudinal measurement of the deepening 92 or 93 is larger (FIG. 3) than the longitudinal measurement of the base plates 23 and 33, then the base plate 23 or 33 can be adjusted for-or backwards in the longitudinal direction of the ski 5 in the deepening 92 or 93.

Figure 14:
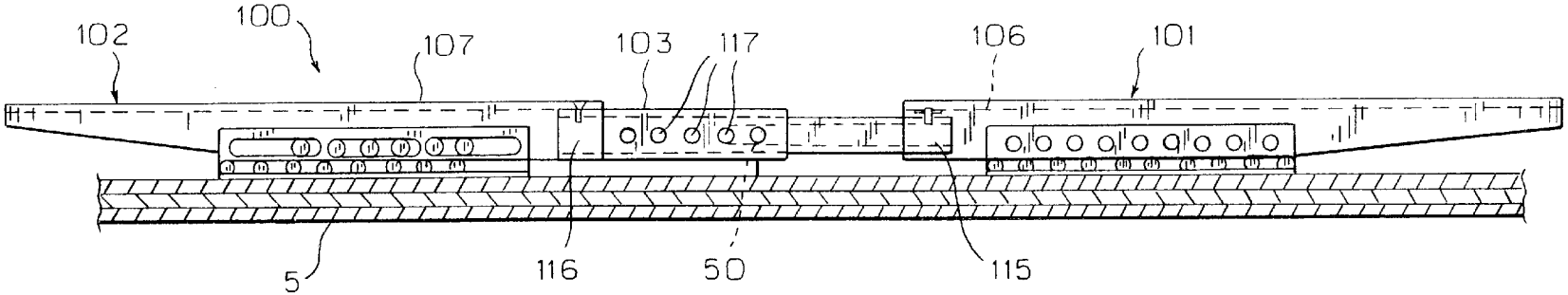
FIG. 14 is a side view of a third embodiment of the present device.
Figure 15:
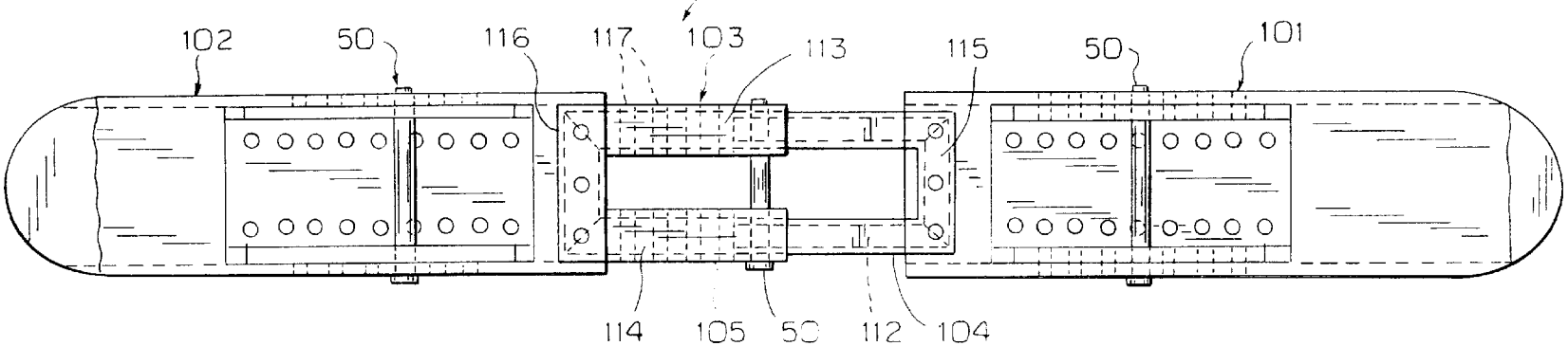
FIG. 15 is a plan view of the device in accordance with FIG. 14.

FIGS. 14 and 15 show a further embodiment of the present device. In this case, the holding arrangement 100 comprises two parts 101 and 102. These parts 101 and; 102 can be manufactured in such a way that the middle section 18 of the holding arrangement 1 according to FIG. 1 or 3 is removed. Consequently, the respective holding part 101 or 102 of the holding arrangement 100 comprises only that one section 106 or 107 of the original base plate 13, which is foreseen for the holding the binding heel 108 (FIGS. 16 and 17) or of the binding toe 109 and which is executed in a known manner for this purpose. Already described legs 11 and 12 hang down from the respective section 106 or 107 of the originally shaped base plate 13. Said legs have the, openings 14 which were also described in the foregoing. Consequently, the respective holding part 101 or 102 can be put on and secured to one of the intermediate pieces 2 or 3 in the manner which was also described in the foregoing.

Between the holding parts 101 and 102 an arrangement 103 is placed, by aid of which the distance between the holding parts 101 and 102 can be set. This setting device 103 comprises two practically U-shaped pieces 104 and 105, from which each one has two legs 111 and 112 or 113 and 114. A crosspiece 115 or 116 is assigned to the respective pair of legs, whereby said cross-piece connects together those ends of the legs of the U-piece 104 or 105 which face or are assigned to the holding part 101 or 102. The cross-piece 115 or 116 of the respective U-piece 104 or 105 is assigned to the underside of the base plate 13 of one of the holding parts 101 or 102 and firmly connected with these. This can be achieved by aid of screws. Those legs 111 and 112 or 113 and 114 of the respective U-piece 104 or 105, which are connected to said cross-pieces 115 and 116, stick out horizontally from the respective holding part 101 and 102.

The legs 111 and 112 or 113 and 114 of the U-piece 104 or 105 is executed as tube piece. The outer diameter of the legs 111 and 112 of one of the U-piece 104 is smaller than the interior diameter of the legs an the other U-piece 105, in fact so that the thinner legs 111 and 112 can move in the larger legs 113 and 114 if possible free of play. In the legs 111 and 112 or 113 and 114 of the U-pieces 104 or 105 openings 117 are executed. The openings 117 in one of the U-pieces can be brought in alignment with the openings 117 in the other U-piece by movement of the U-pieces 104 and 105 to each other, so that the connecting means 50, which was already described, can be inserted through the aligned openings 117. In this way the position of the legs 111 and 12 or 113 and 114 to each other and the distance between the holding parts 101 and 102 to each other adjusted and fixed.

Figure 16:
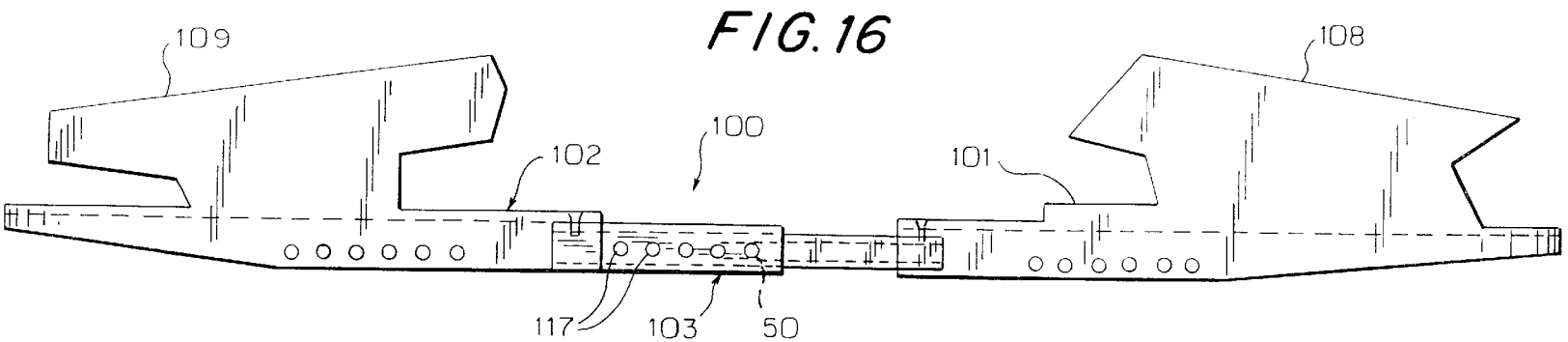
FIG. 16 is a side view of a fourth embodiment of the present device.
Figure 17:
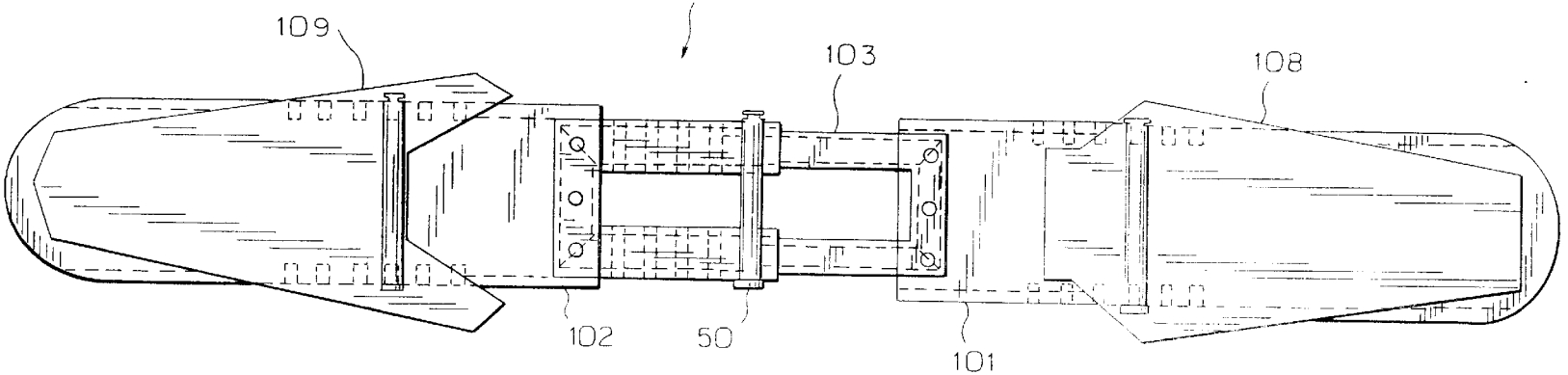
FIG. 17 is a plan view of the device in accordance with FIG. 16.

FIGS. 16 and 17 show a further embodiment of the present device, which differs from embodiment depicted in FIGS. 14 and 15 essentially only in the fact that the respective part 108 or 109 of the ski binding is solidly connected with one of the holding parts 101 or 102 or that they are even in one piece.

For weight-reasons, the holding arrangements and the intermediate pieces, are normally made from an aluminium-alloy. In contrary thereto, the connecting means 50 is normally made from a hard steel. Since the aluminium-alloy is softer than steel, it can happen when using the present device that the material in the area of the margins of the openings in the holding arrangement and in the intermediate pieces yield under pressure of the hard connecting means 50 which pressure is effective in the plane of the openings. Consequently, the openings in the holding arrangement and in the intermediate pieces become larger and in consequence undesired plays between the axis and the holding arrangement or between the axis and the intermediate pieces result therefrom. Such a problem can not arise in the case of the embodiments of the present device described in the following.

Figure 18:
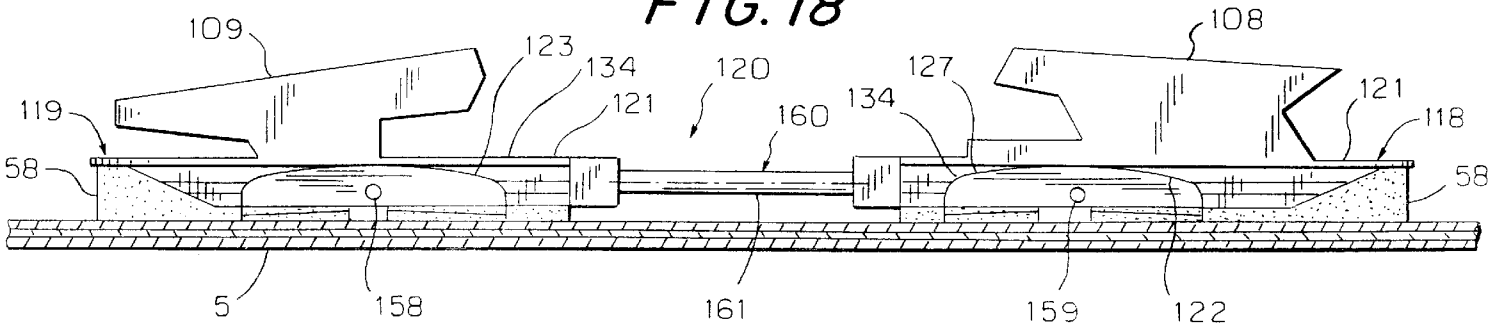
FIG. 18 is a side view of a fifth embodiment of the present device.
Figure 19:
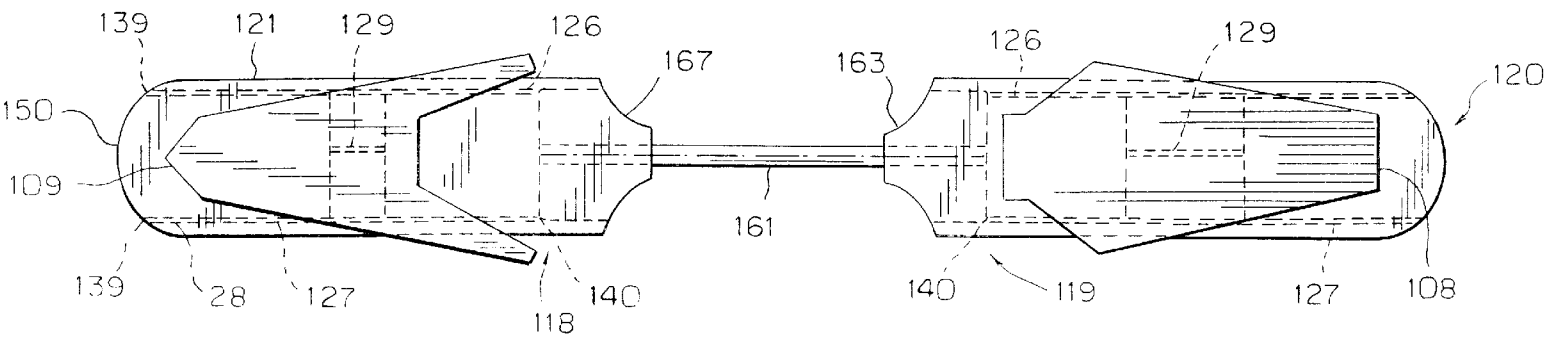
FIG. 19 is a plan view of the device in accordance with FIG. 18.

FIGS. 18 to 24 shows a further embodiment of the present invention. In FIG. 18 a detail from a ski 5 is shown which is equipped with the present device. This device is depicted in FIG. 19 in a plan view and it has a holding arrangement 120 for the shoe of the person using the ski and two intermediate pieces 122 and 123. The holding arrangement 120 comprises two holding parts 118 and 119 which are in a distance from each other. The respective holding part 118 or 119 is by aid of the already described connecting means 50 and with hinged supports connected to the assigned intermediate piece 122 or 123.

The main body 121 of the respective holding part 118 or 119 is executed as a profile piece (FIG. 20), whereby the profile can also be called as box section. The cross-section of the main body 121 is essentially rectangular, whereby this profile is oriented in the present case so, that the longer sides 124 and 125 of the cross-section of this profile extend practically horizontally. These sides represent the upper wall 124 and the lower wall 125 of the box section 121. The shorter sides 126 and 127 of said profile extend vertically between the ends of the longer sides 124 and 125 and they represent the side-walls of the box section. The holding arrangement 120 has a vertically extending middle plane M, in which also a longitudinal axis of the holding arrangement 120 lies. The middle plane M goes through the middle of the width of the horizontal walls 124 and 125.

Between the side walls 126 and 127 of the box section 121 a third, horizontal wall 128 of the box section or profile 121 extends, which lies between said horizontal walls 124 and 125 and which extends parallel to these This partition 128 subdivides the interior of the box profile 121 into an upper chamber 131 and into a lower chamber 132. The heights of these chambers 131 and 132 can be equally large or they can be differently large.

A vertically extending partition 129 lies between the already mentioned side walls 126 and 127 and it extends between the upper wall 124 and the horizontal partition 128. Consequently, the vertical partition 129 is placed in the upper chamber 131 of said profile. The partitions 128 and 129 reinforce further the holding arrangement 120. The vertical partition 129 lies out of the already mentioned middle plane M. This because some of the screws used for fastening of the binding on the upper side of upper wall 124 of said profile take place in the course of the mounting of the binding to in said middle plane M. The bolts (not represented) of the securing screws stick out into the upper chamber 121 of the box-profile 121. If the vertical partition 129 lies out of the middle, then it doesn't hinder said securing screws.

Horizontally extending strips 133 and 134 extend away laterally from each of the upper side edges of the main body 121 of the holding device 120 a at the side. These strips 133 and 134 are in one piece with the main body 121 and they have a practically quadrilateral shaped cross-section, whereby this cross-section is essentially rectangle shaped in the present example. Such a strip 133 or 134 has two horizontally extending longer sides 135 and 136. Over its first shorter side the strip 133 or 134 is connected in one piece to the remaining part of the main body 121 of the holding arrangement 120. This shorter side can also be called the inner shorter side of the strip 123 or 124. A second or outer shorter side 137 of the strip 133 or 134 is rounded in order to prevent that the person using the snow-glider injures himself on which this device is installed.

The upper longer side 135 of said profile and the cross-section of the strip 133 or 134 lie in the present case in the same plane as the surface 138 of the upper wall 124 of the holding arrangement 120. The vertical distance between the longer sides 135 and 136 of the strip 133 or 134 can be as same as the thickness of the upper wall 124 of the main body 121 or it can at least correspond to this. In this case, the strips 133 and 134 represent extensions of the upper wall 124 of the main body 121 which lie opposite to each other. In the principle, the upper side 135 of the strip 133 or 134 can also lie below the surface 138 of the said upper wall 124. The vertical distance between the longer sides 135 and 136 of the strips 133 and 134 can also be different from the thickness of the upper wall 124 of the main body 121.

The lower longer side 136 of the strip 133 or 134 is executed flat and it stands practically rectangularly to the outer surface 139 of that one shorter side wall 126 or 127 which lies at the relevant side of the main body 121.

The end parts of the box beams 118 and 119 are provided with a screw or phase 28 in the front and at the end thereof, whereby these screws 28 extend from below upward. The screw 28 can also be considered as a plane at which the respective walls of the box profile 121 end. The lower corner 140 of the screw 28 lies in the area of the lower wall 125 of the box profile 121 and it is retired with respect to the cross edge 150 of the base plate 121. The cross edge 150 of the base plate 121 extends arched. The upper edge 139 of the screws 28 lies in the area of the underside of the upper wall 124 of the main body 121, in fact in a distance from the said bow 150.

According to FIG. 19 the screw 28 is formed so that only the side walls 126 and 127 of the box profile 121 has the shape described in the foregoing. The lower wall 125 and the interior walls 128 and 129 of the box profile 121 end already in a considerable distance from the lower corners 140 of the screw 28, so that said walls can be very short. Under circumstances, they can only be under the respective part 108 or 109 of the shoe binding. Pieces 58 made from a yielding material are placed between the extending sections of the side walls 126 and 127 of the profile 121. Said extending sections of the side walls 126 and 127 hold said material pieces 58 at place and position at the side.

In the respective side wall 126 or 127 of the main body 121 of the respective holding part 118 or 119 groups 141 and 142 of openings 143 or 144 are executed, through which the connecting means 50 can go through. The respective holding part 118 or 119 of the holding arrangement 120 is hingedly connected over the corresponding axis 50 to one of the intermediate pieces 122 or 123. Within the respective group 141 or 142 the openings 143 or 144 lie in a row one after another, whereby these rows extend in the longitudinal direction of the side walls 126 or 127. The openings 143 of the first group 141 have an oblong contour, whereby the longer measurement of these openings 143 coincides with the longitudinal direction of the respective group 141 or 142. The openings 144 of the second group 142 have in contrast thereto a circular contour. The middle of the openings 143 and 144 of the two groups 141 and 142 are in the area of the lower chamber 132 of the main body 121, so that the connecting means 50 can go through the lower chamber 132. Suitably, the centers of the openings are placed in the middle of the height of the lower profile chamber 132.

The respective intermediate piece 122 or 123 (FIGS. 22 to 24) has a main body 151, the cross-section of which is essentially U-shaped. Such a main body 151 has two legs 152 and 153 and a base plate 154 connecting together the lower margins of these legs 152 and 153. The base plate 154 of the intermediate piece 122 or 123 is essentially plate like. The underside 155 of such a base plate 154 is flat. The upper side 156' of the base plate 154 is convex in the present case. In a vertical longitudinal cut, the upper side 156 of the base plate 154 can have an arched or A-shaped course.: This sectional plane through said convex form extends parallel to the plate-shaped legs 152 and 153 of the intermediate piece 122 or 123. Consequently, the thickness of the base plate 154 is larger in the middle of the length of the same.

Figure 23:
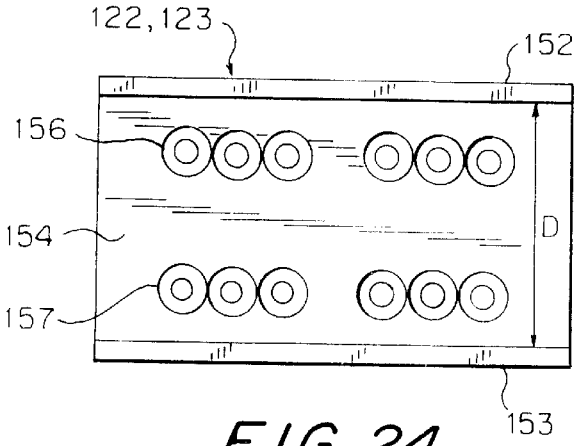
FIG. 23 is a plan view of the first embodiment of the midsection of the intermediate piece in accordance with FIG. 22
Figure 24:
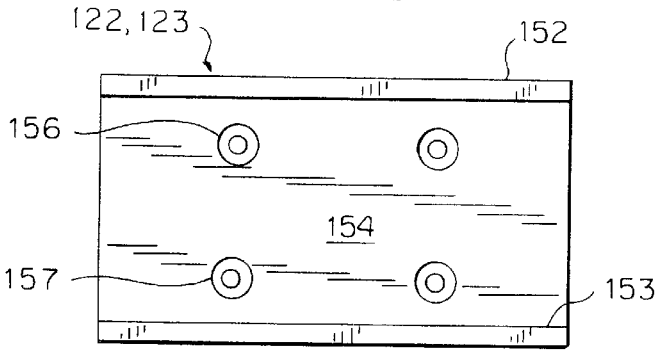
FIG. 24 is a plan view of the second embodiment of the midsection of the intermediate piece.

In the base plate 154 two rows 156 and 157 of openings are executed having a sinking edge. Through these openings, screws can go through for securing of the intermediate piece 122 or 123 on the ski 5. In FIG. 24 an intermediate piece 122 or 123 is shown which is determined for securing on the ski 5, because this intermediate piece 122 or 123 has only two pairs of the openings 156 and 157. The intermediate piece 122 or 123 according to FIG. 23 has two groups of the openings 156 and 157 whereby the openings 156 and 157 form rows in these groups which extend parallel to each other. For the mounting on the ski 5 those holes 156 and 157 of this intermediate piece 122 or 123 can be chosen which ensure the optimal distance between the intermediate pieces 122 and 123 with respect to the function of this device. Since the distance of the holes 156 and 157 within a group is very small, a very fine adjustment of the distance between the intermediate pieces 122 and 123 at the plates 122 or 123 according to FIG. 23 is possible.

The upper contour 167 of the plate shaped legs 152 and 153 is at least partially arched. In the present case, the bow or arch 167 extends over the whole length of the intermediate piece 122 or 123 and the respective end part of the bow 167 lies in the area of the base plate 154 of the intermediate piece 122 or 123. But it is also possible that the bow 167 extends only in the middle area of the leg length.

In the respective leg 152 or 153 an opening 158 or 159 (FIG. 18) is executed, whereby these openings 158 and 159 are suitably placed in the middle of the length of, the bow 167. At one of the intermediate pieces 122 the opening 158 can have an oblong contour, whereby the longitudinal measurement of this opening 158 coincides with the longitudinal measurement of the intermediate piece 122. The openings 158 of the other intermediate piece 123 have in such a case a circular contour. If the holding parts 118 and 119 have the already mentioned oblong openings 153, then all openings 159 in the intermediate pieces 122 and 123 can be circular and vice versa.

Figure 20:
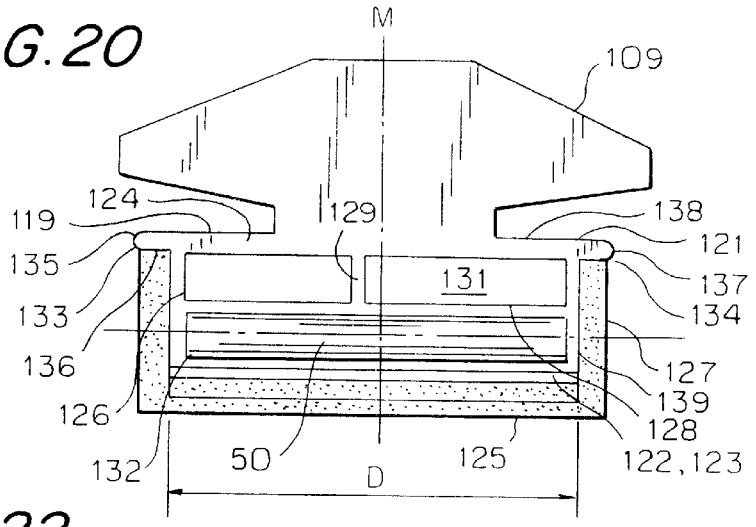
FIG. 20 is a front view of the device in accordance with FIG. 18.
Figure 22:
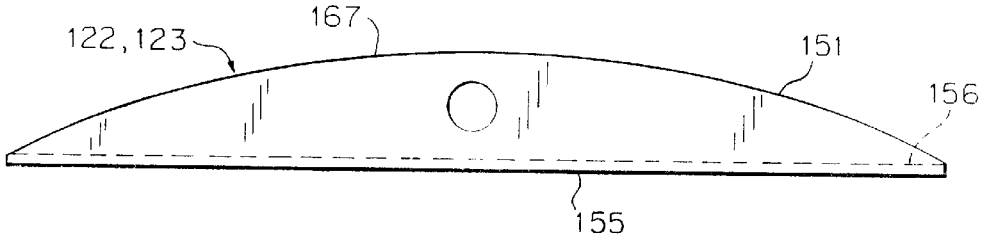
FIG. 22 is an enlarged side view of one of the U-shaped intermediate pieces, the midsection of which is placed between the main-part of the present device and the body of the ski.

The distance D between the interior sides of the legs 152 and 153 (FIG. 23) at the intermediate pieces 122 and 123 corresponds to the distance D (FIG. 20) between the outer sides of the main body 121 of the holding part 118 or 119 in such a way that the main body 121 can be put between the legs 152 and 153 of the intermediate pieces 122 and 123 (FIG. 20). In this position of the holding parts 118 and 119 each one the connecting means 50 extends through the assigned pairs of openings 153 or 154 in the holding parts 118 and 119 and through the pairs of openings 158 and 159 in the intermediate pieces 122 and 123. The main body 121 lies thereby between the legs 152 and 153 practically play free but with respect to the intermediate pieces 122 and 123 swingable about the connecting means 50.

The height of the legs 152 and 153 of the intermediate pieces 122 and 123 is somewhat greater than the height of the side walls 126 and 127 of the main body 121 of the holding part 118 or 119. Consequently, the underside 136 of the strips 133 and 134 at the holding parts 118 and 119 rests on the vertexes of the bows 167 at the legs 152 and 153 of the intermediate pieces 122 and 123 and the lower wall 125 of the holding part 118 or 119 stands in a distance from the ski 5. The height position of the openings 153 and 154 in the holding part 118 or 119 and of the openings 158 and 159 in the intermediate pieces 122 and 123 is chosen so that the strips 133 and 134 rest without play on the bows 167 and that that one section of the holding part 118 or 119, which is assigned to the respective intermediate piece 122 or 123, can swing about the connecting means 50 which is here present.

Because of the described connection to the relevant intermediate piece 122 or 123, the respective holding part 118 or 119 can swing about the respective connecting means 50. This would be very unfavorable for the operation of the present device. In order to make the holding parts 118 and 119 to an integral piece, a connecting arrangement 160 is foreseen which extends between the holding parts 118 and 119. Furthermore, this connecting arrangement 160 is also executed in such a manner that the distance between the holding parts 118 and 119 can be adjusted.

The connecting arrangement 160 includes a longitudinal member 161 which extends between the holding parts 118 and 119, whereby the end parts of this member 161 are embedded in the relevant holding part 18 or 119. The longitudinal member 161 can be formed as a screwed spindle and it is placed approximately in the middle of the width of the holding parts of 118 and 119. The connecting arrangement 160 comprises also hollow members 162 and 163, which are adapted for receiving of the end parts of the longitudinal member 161. Each one of these hollow members 162 or 163 is firmly connected to one of the holding parts 118 or 119. The hollow member 162 or 163 is firmly connected to that one end part of the holding part 118 or 119 which faces the other holding part 119 or 118.

The nut-similar hollow-member 162 or 163 is arranged and secured in the interior of the hollow and in the foregoing described profile of the main body 121 at the relevant holding part 118 or 119 in a per se known manner. That one end part 162 or 163 of the holding part 118 or 119 which faces the other holding part, can also be executed from a solid material, in which the necessary screw thread is cut in for receiving the longitudinal member 161. Suitably, the respective half of the longitudinal member 161 is provided with a screw thread, whereby the pitches of these screw threads run in the opposite directions The pitches,of screw threads in the hollow members 162 and 163 run also in the opposite directions, so that the holding parts 118 and 119 come nearer or go away from each other, if the longitudinal member 161 is rotated in the one or in the other direction.

The insert 58, which was already described in the foregoing, can be assigned to the respective holding part 118 or 119. Said insert 58 can be made up from a yielding material, for example from rubber, from a plastic material, especially from a foam like plastic etc. FIG. 18. But such an insert 58 can also be assigned only to that one end area of the respective holding part 118 or 119, which is directed outwardly. The insert 58 can extend continuously under the holding part 118 or 119 or such inserts 58 can be placed in the end areas of the respective holding part 118 or 119. Thereby it is possible, that the inserts 58 at the ends of the holding part 118 or 119 has different resilience, so that the behavior of those section of the ski 5, which stick out in the front and behind from the holding parts 118 and 119 can be influenced in different manner by different inserts. For example, the insert 58 in the front can be softer than the insert 58 behind. The respective insert 55 can lateral be held at place by the sloped extending end parts 28 of the box profile 121. The inserts 58 can positively control the ability to swing and the flex of the ski 5, especially the damping thereof.

During the operation of the present device, the ski 5 bows, in fact first of all in the middle area of the length of the same, as this is caused by the course of the terrain used straight-away. Thereby, the relevant section of the underside 116 or 136 of the respective strip 113 and 114 or 133 and 134 engages the bow 137 or 167 of the assigned leg 132 and 133 or 152 and 153. The main stress acting on the ski 5, which is caused by the weight of the ski users and which is received by the ski or shoe binding can be transferred directly and over the strips 113 and 114 or 133 and 134 of this arrangement 100 or 120 to the legs 132 and 133 or 152 and 153 of the intermediate pieces 102 and 103 or 122 and 123 by-passing practically the connecting means 50. The connecting means 50 serves in this device in fact only for retaining the holding arrangement 100 or 120 between the legs 132 and 133 or 152 and 153 of the intermediate pieces 102 and 103 or 122 and 123, actually during the forward movement of the ski and during a temporary relief of the same, e.g. when ski user executes a jump.

If the middle area of the ski 5 bows, the distance changes between the openings in the intermediate pieces, which are secured on the ski 5. But the distance between the openings in the holding arrangement 100 or 120 remains unchanged. The changes of said distance between the openings are however very small, so that the oblong openings in the holding arrangement or/and the oblong openings in one of the intermediate pieces can pull out such changes of said distance.

The groups of the openings in the holding arrangement enable altering stiffness of the middle part of a given the ski 5, as requested. This happens in such a manner that the connecting means 50 are put through the openings of the relevant group in the holding arrangement which lie more near to or more spaced from each other. There, the position of at least one of the intermediate pieces 102 and 103 on the ski 5 must however accordingly be adjusted. This therefore, because the legs of the intermediate pieces has only one opening. The adjustment of the position of intermediate pieces is possible, because the base plate of the respective intermediate piece has openings, which lie in the longitudinal direction of the ski 5 one after other.

The described convex form of the upper side of the base plate of the respective intermediate piece makes greater the swinging area of the intermediate piece with respect to the holding arrangement, because the intermediate piece can swing in a broadened area with respect to the holding arrangement. On the other hand this makes possible, to reduce the height of the legs and consequently also the height of the entire device.

Figure 21:
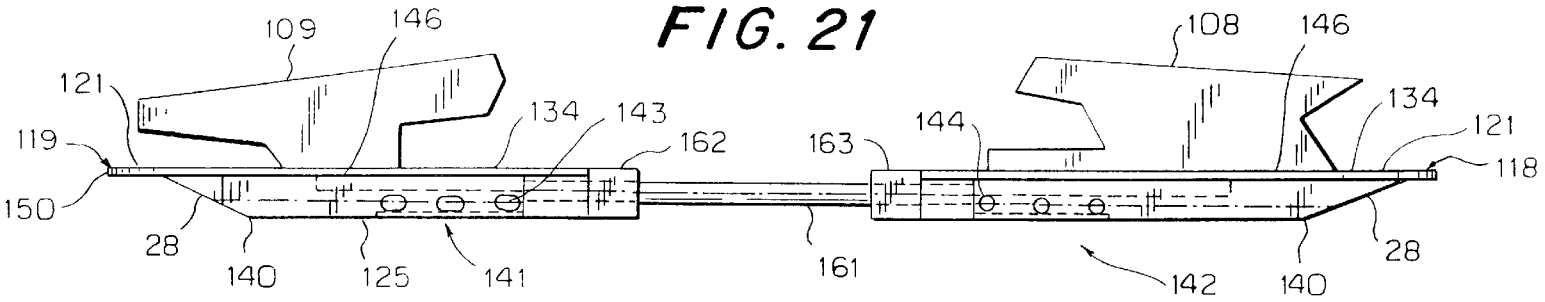
FIG. 21 is a side view of the main part of the device in accordance with FIG. 18.

FIG. 21 shows furthermore a further embodiment of the present device. At this embodiment, the binding heel 108 and the binding toe 109 are not in one piece with the main body 121 of the respective holding part 118 or 119, but the binding heel 108 and the binding toe 109 are connected to the main body 121 of the relevant holding part 118 or 119 in such a way, that they are movable in the longitudinal direction of the device and that the adjusted position of the same can be fixed. Such an attachment 146 can occur for example by aid of rails which are in gear and which are on the holding parts 118 and 119 and on the parts 108 and 109 of the binding, and by aid of a corresponding fixing arrangement. The edges of said rails can be undercut, so that a dovetail-connection exists between the holding parts 118 and 119 and binding parts 108 and 109 assigned to these holding parts 118 and 119. For the fixing of the position of the binding parts 118 and 119 adjusted with respect to the holding parts 118 and 119 screws (not shown) can e.g. be used, which go through the binding parts 108 and 109 and which are screwed in the main body 121 of the relevant holding part 118 or 119.

The described embodiments of the present device can be mounted e.g. on skis, snowboards and gliders.

What is claimed is:

1. Device for connecting a ski to a shoe of a person using the ski, comprising:

a shoe binding having two components (108, 109) which respectively serve to secure a tip and a heel of a shoe;

intermediate pieces (2, 3, 122, 123) adapted to be fixed on the ski at a distance from each other, a holding arrangement (1, 100, 120) on which the two components (108, 109) of said shoe binding are placed, whereby the holding arrangement (1, 100, 120) rests on said intermediate pieces (2, 3, 122, 123);

wherein said holding arrangement (1, 100, 120) has two holding parts (101, 102, 118, 119) placed at a distance from each other;

each of the two holding parts (101, 102, 118, 119) respectively receiving one of the two components (108, 109) of the shoe binding; and a setting device (103, 160) engaged between the two holding parts (101, 102, 118, 119) of the holding arrangement (100, 120);

wherein said two holding parts (101, 102, 118, 119) of the holding arrangement (1, 100, 120) are engaged in a given position with respect to the intermediate pieces (2, 3, 122, 123);

wherein the setting device adjusts and fixes the distance between said two holding parts (101, 102, 118, 119) of the holding arrangement (1, 100, 120).

2. Device according to patent claim 1, wherein the setting device (100) has two substantially u-shaped pieces (104, 105), each having a pair of legs (111, 112, 113, 114), a bridge (115, 116) connecting each said pair of legs, each said bridge (115, 116) being respectively interconnected with a base plate (13) of the two holding parts (101, 102), so that each said pair of legs extend out from the base plate, wherein measurements of a cross-section of both pair of legs are chosen so, that one of the pair of legs can be inserted into another of the pair of legs and that said both pair of legs have corresponding openings (110) through which bolts (50) can be inserted to fix a distance between the two holding parts.

3. Device according to patent claim 1, wherein the setting device (160) has a longitudinal member (161), which extends between the two holding parts (118, 119) of the holding arrangement (120) and has two receiving members (162, 163) for respectively receiving each end portion of the longitudinal member (161); the two. receiving members (162, 163) being engaged respectively to the two holding parts (118, 119) of the holding arrangement (1, 100, 120).

4. Device according to patent claim 3, wherein the longitudinal member (161) is a screw spindle and the two receiving members are hollow members (162, 163) in which each said end portion of the longitudinal member (161) are respectively fixed, wherein each of the hollow receiving member (162, 163) is fixed to an end portion of each of the two holding parts (118, 110) of the holding arrangement (120).

5. Device according to the patent claim 4, wherein the longitudinal member (161) is placed approximately in a middle of a width of the two holding parts (118, 119).

6. Device according to patent claim 4, wherein the two receiving members (162, 163) have screw threads for respectively engaging an end portion of the screw spindle (161) and that the hollow member (162, 163) is arranged and secured in an interior of a hollow main body (121) of each of the two holding parts (118, 119).

7. Device according to patent claim 4, wherein the two receiving members are formed from a solid material, each having a screw thread cut in for respectively receiving the end portions of the screw spindle.

8. Device according to patent claim 4, wherein the screw spindle is provided at opposite ends; with a screw thread which have pitches running in opposite directions, screw threads in the two receiving members (162, 163) having corresponding pitches to that of the screw spindle, so that the two holding parts (118, 119') come nearer or apart from each other when the screw spindle, (161) is rotated in the one or in the other direction.

9. Device according to patent claim 1, the main body (10) of the holding arrangement (10) has a base plate (10), that at least two lamellar or plate-shaped legs (11, 12) extend out from said base plate, each of the intermediate pieces (2, 3) having two lamellar or plate-shaped legs (21, 22, 31, 32)

which extend parallel to the legs (11, 12) of the holding arrangement (1), the distance between the legs (11, 12) of the holding arrangement (1) is such that the legs (11, 12) can be placed between the legs (21, 22, 31, 32) of the intermediate pieces (2, 3), the respective leg (11, 12, 21, 22, 31, 32) of the holding arrangement (1) and of the intermediate pieces (2, 3) having at least one opening (14, 24, 34), two connecting means (50) which are placed at a distance one from the other and each one of the connecting means (50) extending through in corresponding openings in overlapping legs.

10. Device according to patent claim 9, wherein the main body (10) of the holding arrangement (10) has interior legs (81, 82, 83, 84), which are placed between exterior legs (11, 12) of the main body (10), the interior legs (81, 82, 83, 84) extending parallel to the legs (11, 12) and the interior legs having openings corresponding to those of the exterior legs.

11. Device according to patent claim 1, wherein each of the intermediate pieces (122, 123) has a main body (151), the cross-section of which is essentially U-shaped, the main body (151) having two legs (152, 153) and a plate (154) connecting together lower edges of said legs (152, 157) which have a sinking edge, an upper contour (167) of each of the two legs (152, 153) being at least partially arched, each of the two leg (152, 153) having an opening (158, 159) placed below a middle region of the upper contour (167).

12. Device according to patent claim 11, wherein the upper contour (167) extends over a full length of each of the intermediate pieces (122, 123) and ends of the upper contour (167) lie in an area of the base plate (154) of the intermediate pieces (122, 123).

13. Device according to patent claim 11, wherein the upper contour (167) extends only in a middle area of a length of the two legs (152, 153).

14. Device according to patent claim 11, wherein each of the two holding parts (118, 119) has a box shaped main body (121), peripheral longitudinal edges of the main body (121) having laterally extending longitudinal ribs (133, 134), the box shaped main body (121) being located between the legs (152, 153) of the intermediate piece (122, 123) and each of the longitudinal ribs (133, 134) resting on the upper contour (167) of the legs (152, 153) of the intermediate piece (122, 123).

15. Device according to patent claim 14, wherein the binding heel (108) and the binding toe (109) are in one piece with the main body (121) of each of the two holding parts (118, 119).

16. Device according to patent claim 14, wherein the two components of the shoe binding are respectively connected to the main body (121) of each of the two holding parts (118, 119) in such a way, that the two holding parts are movable in a longitudinal direction of the device and that an adjusted position thereof can be fixed.

17. Device according to patent claim 16, wherein an attachment (146) occurs by aid of rails which are in gear and which are arranged on the two holding parts (118, 119) and on the two component parts (108, 109) of the shoe binding and by aid of a corresponding fixing arrangement, whereby edges of said rails can be undercut, so that a dovetail-connection respectively exists between the two holding parts (118, 119) and the two component parts (108, 109).

18. Device according to patent claim 14, wherein horizontally extending strips (133, 134) extend away laterally from each of upper side edges of the main body (121) of the holding device (120) at a side, the strips (133, 134) representing extensions of the upper wall (124) of said main body (121) and are formed as a unitary piece with said main body (121).

19. Device according to patent claim 18, wherein a cross-section of the strips (133, 134) is substantially rectangle shaped, an upper longer side (135) of the strip (133, 134) lies in same plane as a surface (138) of the upper wall (124) of the holding arrangement (120), the thickness of the strips (133, 134) are a same thickness as that of the upper wall (124) of the main body, a lower longer side (136) of the strip (133, 134) is flat and stands substantially rectangularly to an outer surface (139) of shorter sides (126, 127) which lies at a corresponding side of the main body (121).

20. Device according to patent claim 11, wherein a cross-section of the main body (121) of the two holding parts (118, 119) is substantially rectangular, and is oriented so, that longer sides (124, 125) of said cross-section extend substantially horizontally and shorter sides (126, 127) thereof extend vertically and wherein the holding arrangement (120) has a vertically extending middle plane, which extends through a middle of a width of the longer sides of the cross-section of the main body (124, 125).

21. Device according to patent claim 20, wherein two groups (141, 142) of openings (143, 144) are located in the shorter sides (126, 127) of the main body (121) of the two holding parts (118, 119), wherein the openings (143, 144) lie in a row one after another, whereby these rows extend in the longitudinal direction of the shorter sides (126, 127), the openings (143) of a first group (141) having an oblong contour, whereby a longer measurement of the openings (143) coincides with a longitudinal direction of a corresponding group (141, 142), the openings (144) of a second group (142) having a circular contour and a middle of the openings (143, 144) of the two groups (141, 142) being in an area of the lower chamber (132) of the main body (121).

22. Device according to patent claim 20, wherein between the shorter sides (126, 127) of the main body (121) a third, horizontal wall (128) of the main body (121) extends, which lies between said longer sides (124, 125) and which extends parallel thereto, wherein the horizontal wall subdivides an interior of the main body (121) into an upper chamber (131) and into a lower chamber (132), wherein a vertically extending partition (129) lies between the shorter sides (126, 127) and extends between an upper wall (124) and the horizontal wall (128) and that the vertical extending partition (129) lies out of the middle plane.

23. Device according to patent claim 22, wherein a height of the legs (152, 153) of the intermediate pieces (122, 123) is greater than the height of the shorter sides (126, 127) of the main body (121) of the two holding parts (118, 119) so that the lower longer side (136) of the strips (133, 134) at the two holding parts (118, 119) rests on vertexes of the upper contours (167) of the legs (152, 153) of the intermediate pieces (122, 123) and that the longer side (125) of the holding part (118, 119) stands at a distance from the ski (5).

24. Device according to patent claim 22, wherein a height of the openings (143, 144) in the two holding parts (118, 119) and of the openings (158, 159) in the intermediate pieces (122, 123) are chosen so that the strips (133, 134) rest without play on the upper contours (167) and that one section of each of the two holding parts (118, 119), which is assigned to the respective intermediate piece (122, 123), can swing about a pin (50) which goes through corresponding openings (143, 144) in the two holding parts (118, 119) and through corresponding openings (158, 159) in the intermediate pieces (122, 123).

25. Device according to patent claim 24, wherein one pin (50) connects the holding arrangement (120) and one of the intermediate pieces (122, 123), the pin: (50) having a shaft (54) with a substantially cylindrical outer surface and further having elements (64, 66), which prevent an exit of the shaft (54) from the device.

26. Device according to patent claim 11, wherein the openings (158) has an oblong contour and a longitudinal measurement of the opening (158) coincides with a longitudinal measurement of each of the intermediate pieces (122).

27. Device according to patent claim 26, wherein end parts of the main body (121) of each of the two holding parts (118, 119) are provided with a phase (28), the phases (28) extending from below upward, a lower corner (140) of the phase (28) lying in the area of the longer side (125) of the main body (121) and retiring with respect to a leading cross edge (150) of the main body (121), which can be arch shaped, the cross edge (150) of the main body (121) extends an upper edge (139) of the phases (28) lying in an area of an underside of the upper wall (124) of the main body (121) at a distance from the leading cross edge (150).

28. Device according to patent claim 27, wherein the phase (28) is horizontally formed, and the longer side (125) and interior walls (128, 129) of the main body (121) end being a considerable distance from the lower corners (140) of the phase (28), so that said walls can be very short.

29. Device according to patent claim 28, wherein an insert (58), which is formed from a yielding material, is assigned to each of the two holding parts (118, 119), wherein the insert can be made from rubber, from a plastic material, or from a foam like plastic.

30. Device according to patent claim 29, wherein said insert (58) extends continuously under the two holding parts (118, 119).

31. Device according to patent claim 29, wherein said insert (58) is assigned only to one end area of each of the two holding parts (118, 119), and is directed outwardly, wherein the insert (58) is placed between extending sections of the side walls (126, 127) of the main body (121), so that said extending sections of the shorter sides (126, 127) hold said insert (58) in place and positioned at a side.

32. Device according to patent claim 31, the inserts (58), which are placed in said end areas of each of the two holding parts (118, 119), having different resiliencies, so that behavior of sections of the ski (5), which extend out in a front and behind from the two holding parts (118, 119), can be influenced in a different manner by the inserts having different resiliencies.

* * * * *